United States Patent [19]

Nagatsuka et al.

[11] Patent Number: 4,984,340

[45] Date of Patent: Jan. 15, 1991

[54] METHOD AND APPARATUS FOR SEWING TOGETHER PIECES OF CLOTH WITH JET STREAMS

[75] Inventors: Yoshihiro Nagatsuka; Kenji Fukuta, both of Tsukuba, Japan

[73] Assignee: Agency of Industrial Science & Technology, Tokyo, Japan

[21] Appl. No.: 374,142

[22] Filed: Jun. 30, 1989

[30] Foreign Application Priority Data

Jul. 1, 1988 [JP] Japan ..... 63-165668
Aug. 12, 1988 [JP] Japan ..... 63-202135

[51] Int. Cl.[5] ..... D04H 3/10
[52] U.S. Cl. ..... 28/104
[58] Field of Search ..... 28/104, 105; 112/2, 112/262.1; 428/234, 299, 300

[56] References Cited

FOREIGN PATENT DOCUMENTS 2265891 10/1975 France ..... 28/104

*Primary Examiner*—Werner H. Schroeder
*Assistant Examiner*—Paul C. Lewis
*Attorney, Agent, or Firm*—Oblon, Spivak, McClelland, Maier & Neustadt

[57] ABSTRACT

Pieces of cloth are superimposed, with sewing fibers extending from themselves or separately placed on them. Fine jet streams of a liquid or a mixed fluid of gas and liquid under pressure are shot against the superimposed pieces of while moving the shooting position relative to the cloth. Then, the superimposed pieces of cloth are sewn together by the action of the jet streams that causes the sewing fibers to twine with the cloth. The jet streams are shot to the same point on the superimposed pieces of cloth from their both sides, thus causing the sewing fibers to twine with one another or with the superimposed pieces of cloth. At the same time, the resulting splashes of the sprayed fluid are sucked and removed from therearound. The jet streams acting on the sewing fibers from both sides cause them to sew together the superimposed pieces of cloth. The jet streams penetrating deep into the superimposed pieces of clotch collide with each other at high speed and vigorously splash about, accomplishing effective twining of the sewing fibers and leaving little liquid within the superimposed pieces of cloth. Most of the liquid splashes about and is removed from within surrounding covers through suction units.

10 Claims, 4 Drawing Sheets

METHOD AND APPARATUS FOR SEWING TOGETHER PIECES OF CLOTH WITH JET STREAMS

FIELD OF THE INVENTION

This invention relates to a method and apparatus for sewing together superimposed pieces of cloth with jet streams of a liquid or a mixed fluid of gas and liquid supplied under high pressure.

DESCRIPTION OF THE PRIOR ART

An automatic sewing system prepares various parts by automatically sewing and putting together cut pieces of cloth. To reduce the movement of a manipulator required in the handling of materials, such as cut pieces of cloth and prepared parts, it is necessary to increase the frequency of temporary tack sewing and increase the accuracy of that operation.

In the conventional sewing processes, complex large sewing machines are used for temporary and final sewing. Using a multiplicity of such conventional sewing machines for temporary sewing in an automatic sewing process, however, imposes heavy work loads on both software and hardware of the whole system because of their complex mechanism. It has therefore been desired to develop a new simple sewing mechanism that is capable of not only common sewing but also intricate sewing along curved lines and surfaces.

To fulfill such requirement, the inventors proposed a method for sewing together pieces of cloth with jet streams, with a view to developing a simple sewing mechanism adaptable to various modes of sewing, as is disclosed in Japanese Provisional Patent Publication No. 259669 of 1985.

In this proposed method, two pieces of cloth to be sewn together are placed, one over the other, on a holder, with fine jet streams of high-pressure fluid sprayed from above onto sewing fibers extending from the pieces of cloth themselves or separate ones placed thereon. The pieces of cloth are then sewn together with the fibers that are passed and twined into the underlying pieces of cloth by the action of the jet streams. In this method, the cloth holder serves as a reflector to bounce the jet streams, thus causing a violent turbulence in the jet streams colliding with the holder. Basically, the disturbed jet streams cause the fibers in the superimposed pieces of cloth to intertwine to accomplish the desired sewing.

It has been confirmed that the above method produces a sewing effect equivalent to temporary and final sewing. But the use of water gives rise to the need to prevent the wetting and associated staining of the cloth. As such, it has been desired to provide an effective operating condition under which the used water can be removed easily and the residual moisture content in the cloth minimized.

To achieve a secure sewing, it is indispensable for a fluid sewing mechanism of the type just described to have a mechanism that sharply turns the direction of the jet streams inside the superimposed pieces of cloth, like the reflector in the above-described apparatus. Seemingly, on the other hand, the wetting of the sewn cloth depends on the amount of water present on the reflector as the cloth wipes off the water thereon. To avoid this wetting, therefore, it is preferable to use a mechanism that dispenses with the reflector.

SUMMARY OF THE INVENTION

A primary object of this invention is to provide a sewing method and apparatus that has a mechanism to create a sharp turn in jet streams, like the reflector described previously, to obtain a secure sewing, with provisions made not to encourage the wetting of the sewn cloth thereby.

Another object of this invention is to provide a sewing method and apparatus to achieve effective sewing by creating a sharp turn in jet streams sent forth toward both sides of superimposed pieces of cloth, one on top of the other, by causing the jet streams to collide with each other, rather than using the deflector used in the conventional method described before, with provisions made to minimize the wetting of the cloth by the splashing liquid.

Still another object of this invention is to provide a sewing method and apparatus in which the splashing liquid resulting from the jet streams shot toward both sides of superimposed pieces of cloth, one on top of the other, is sucked and removed through covers enclosing the jet sprays, thereby minimizing the wetting of the cloth thereby.

It is true that the wetting of the sewn cloth can be minimized when the splashes of the sprayed liquid is sucked and removed with air through the cover of the type just described. But the suction may sometimes vertically part the superimposed pieces of cloth, thus making it difficult to achieve a perfect sewing. This tendency is more pronounced when a large space is left between the top and bottom covers to allow for operations handling thicker pieces of cloth.

Yet another object of this invention is to provide a sewing method and apparatus in which the superimposed pieces of cloth are prevented from vertical parting by the suction caused while the splashing liquid from both sides thereof through the covers is sucked and removed and always assure the achievement of stable sewing despite a variation in the thickness of the superimposed pieces of cloth.

In the proposed technology mentioned before, the jet streams are directed to only one side of the superimposed pieces of cloth. Therefore, the fluid must be shot forth under a pressure high enough to ensure that the action of the jet stream extends throughout the entire thickness of the superimposed pieces of cloth.

Still another object of this invention is to provide a sewing method and apparatus in which jet streams are shot forth from both sides of the superimposed pieces of cloth, thereby permitting the lowering of the fluid pressure and preventing the damage of the cloth.

In a method of sewing together pieces of cloth by holding them, with one of them laid on top of the other, with sewing fibers extending therefrom or separate ones placed thereon, shooting fine jet streams of a liquid or a mixed fluid of gas and liquid under pressure against the cloth and causing the sewing fibers to twine with the cloth under the action of the jet streams while moving the shooting position thereof relative to the cloth, the method according to this invention provides a characteristic improvement that the jet streams are shot to the same point from both sides of the superimposed pieces of cloth, thus causing the sewing fibers to twine with one another or with the superimposed pieces of cloth and, at the same time, the resulting splashes of the sprayed fluid is sucked and removed from therearound.

In a sewing apparatus according to the present invention comprises means for holding pieces of cloth, with one placed on top of the other, with sewing fibers extending from the superimposed pieces of cloth themselves or separate ones placed thereon, jet spray means to shoot a fine jet streams of a liquid or a mixed fluid of gas and liquid under pressure from nozzles to the superimposed pieces of cloth and means for moving the shooting position of the nozzle relative to the superimposed pieces of cloth, the apparatus according to this invention provides an improvement that nozzles are disposed to shoot jet streams to the same position from both sides of the superimposed pieces of cloth, with a space surrounding the nozzles enclosed with two covers leading to a device that sucks and removes the splashing fluid.

A keeping plate may be provided, as required, to at least one of the covers. Covering the space surrounding the jet nozzles in conjunction with the cover, the keeping plate urged by an elastic member holds the superimposed pieces of cloth between itself and the other cover.

The method and apparatus according to this invention are applicable to the sewing of various kinds of cloths generally used for clothing and equivalent, including towels, laces, machine-knitted fabrics and non-woven cloths. Woolly, feathery and piled cloths may derive greater benefit because of their own fibers that are suited to the sewing operation of this invention and, thus, eliminate the need of preparing separate sewing fibers.

Generally water under a pressure of 300 to 1000 $kgf/cm^2$ is shot from nozzles with an inside diameter of approximately 0.05 to 0.1 mm as the jet streams of high-pressure fluid. The shooting conditions are varied with the properties of cloth to be sewn together and fibers to sew with.

Jet streams from the nozzles may be shot either intermittently or continuously. Though water or other liquids are generally used as jet streams, a mist produced by atomizing water or other forms of gas-liquid mixtures can be used as well. When seams need some post-treatment, surface treatment or other types of chemicals may be used instead of water.

DESCRIPTION OF THE PREFERRED EMBODIMENTS

Figure 1:
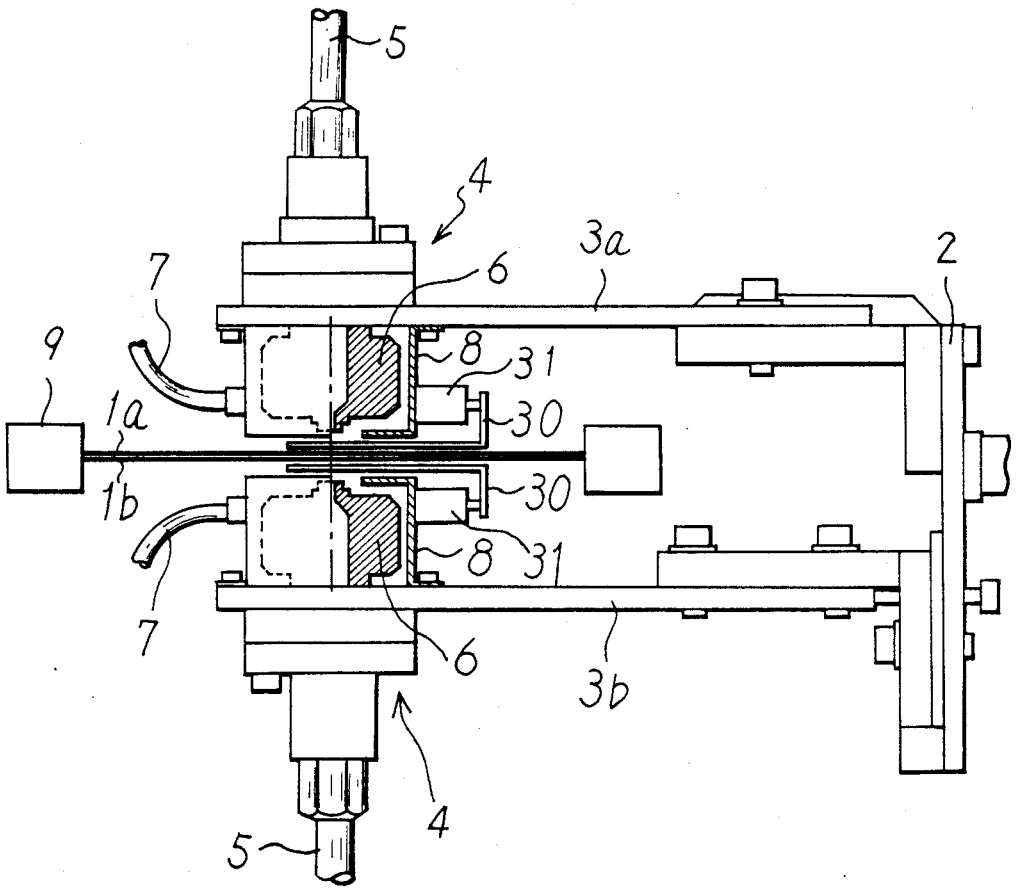
FIG. 1 is a partially cut-away front view of a preferred embodiment of a cloth sewing apparatus according to this invention.

FIG. 1 shows a preferred embodiment of a sewing apparatus according to this invention.

The function of this sewing apparatus is to sew together pieces of cloth 1*a*, 1*b*, with one placed on top of the other, with high-pressure jet streams. An upper and a lower arm 3*a*, 3*b* attached to a support frame 2 carry means 4,4 to shoot forth fine jet streams of a liquid or a mixed fluid of gas and liquid under high pressure. Each shooting means 4 has a nozzle 6 that is connected to a compressor not shown, through a high-pressure fluid pipe 5. A pair of nozzles 6 are vertically disposed in opposite positions so that they shoot jet streams to the same point on both sides of the superimposed pieces of cloth 1*a*, 1*b*. Each of the nozzles 6 is covered with a cover 8 that leads to a suction unit not shown, through a suction pipe 7.

The superimposed pieces of cloth 1*a*, 1*b* to be sewn together are held in position by various means. For example, a cloth holding frame 9 holds their periphery to keep them under a given tension. When the cloths are long, rollers may be used to hold both ends under an appropriate tension.

To sew together the superimposed pieces of cloth 1*a*, 1*b*, the relative jet stream shooting position of the nozzles 6 must be moved by shifting the support frame 2 in a horizontal plane. Or otherwise, provisions may be made to move the means holding the superimposed pieces of cloth 1*a*, 1*b* in a horizontal plane while fastening the support frame 2 in a fixed position.

When the superimposed pieces of cloth 1*a*, 1*b* themselves have woolly or feathery fibers that can be used as sewing fibers, high-pressure jet streams may be shot directly onto them. But when they have little or no such fibers, separate sewing fibers must be placed on both sides thereof, with jet streams shot onto both added fibers and cloths. This jet-stream sewing is applicable to a wide variety of cloths generally used for clothing.

It is preferable to shoot jet streams of compressed water from the nozzles 6 through the high-pressure fluid pipes 5. A mist formed by mixing air with the compressed water may be used, too. Generally, water compressed under a pressure of 300 to 1000 $kgf/cm^2$ is ejected from nozzles having an inside diameter of 0.05 to 0.1 mm. When the seams need some post-treatment chemicals, surface treatment or other types of chemicals may be used instead of water.

The superimposed pieces of cloth 1*a*, 1*b* held by the holding frame 9 or the like are sewn together by moving the shooting position of the jet streams from the nozzles 6. The jet streams shot against both sides of the superimposed pieces of cloth 1*a*, 1*b* cause the sewing fibers to twine with one another or with the pieces of cloth. The jet streams striking the surface of the superimposed pieces of cloth 1*a*, 1*b* splash therefrom. Some portions of the jet streams shot to the same point from above and below penetrate into the superimposed pieces of cloth and collide with each other at high speed. Resulting vigorous splashing leaves little liquid inside the superimposed pieces of cloth 1*a*, 1*b*.

While this sewing operation is under way, the suction unit exhausts the atmosphere from within the covers 8 surrounding the nozzles 6. Therefore, the splashing liquid is also removed through the suction pipe 7.

Now the results of an experiment conducted on a sewing operation with the method and apparatus of this invention will be described in the following:

Table 1 shows the particulars of the material cloth used in the experiment.

TABLE 1

| Description of Specimen | | Cotton cloth (100% cotton) |
|---|---|---|
| Texture | | Plain fabric |
| Weight | | $1.11 \times 10^{-2}$ g/cm$^2$ |
| Thickness | | $2.81 \times 10^{-2}$ cm |
| Density | Warp | 52 fibers/cm |
| | Weft | 23.8 fibers/cm |
| Yarn Count | Warp | 41.9 s |
| | Weft | 42.2 s |

Two pieces of cloth, each having a size of 24 cm by 6.5 cm, were cut out from the material cloth shown above, with the longer side running along the warps. The two pieces of cloth were superimposed and horizontally stretched between a pair of nozzles 6, one placed above the other as shown in FIG. 1, with a tension of 10 gf/cm exerted in the longitudinal direction of the superimposed pieces of cloth. The superimposed pieces of cloth were sewn together by running the nozzles 6, shooting high-pressure jet streams rectilinearly in the direction of the length of cloths (i.e., in the direction of the warps thereof) while keeping the nozzles in opposite positions.

To determine the relationship among the running speed of the nozzles, seam strength and water content in the superimposed pieces of cloth, the nozzles were moved at four different speeds ranging from 1 m/min to 5 m/min. The suction force at the inlet end of the suction pipe 7 was 25 gf/cm$^2$.

From the sewn product, a test specimen for the T-type seam strength test, 3 cm wide by 6.5 cm long, was prepared, with the width thereof running along the seam line formed by the action of the jet streams. The water content was determined by measuring the weight of the superimposed pieces of cloth (24 cm long by 6.5 cm wide) before and immediately after the sewing operation. The difference in weight thus derived was translated into the water content per centimeter of the seam line.

Figure 2:
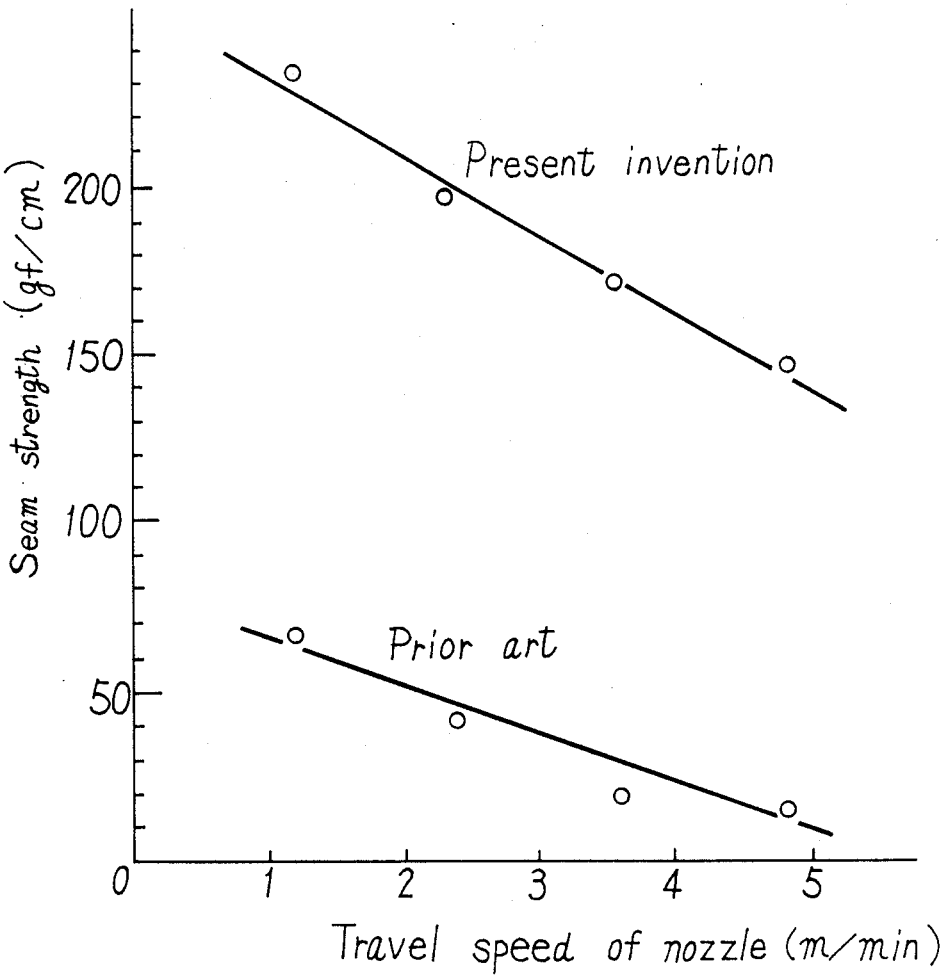
FIGS. 2 and 3 show the results of experiments conducted on the sewing method according to this invention.
Figure 3:
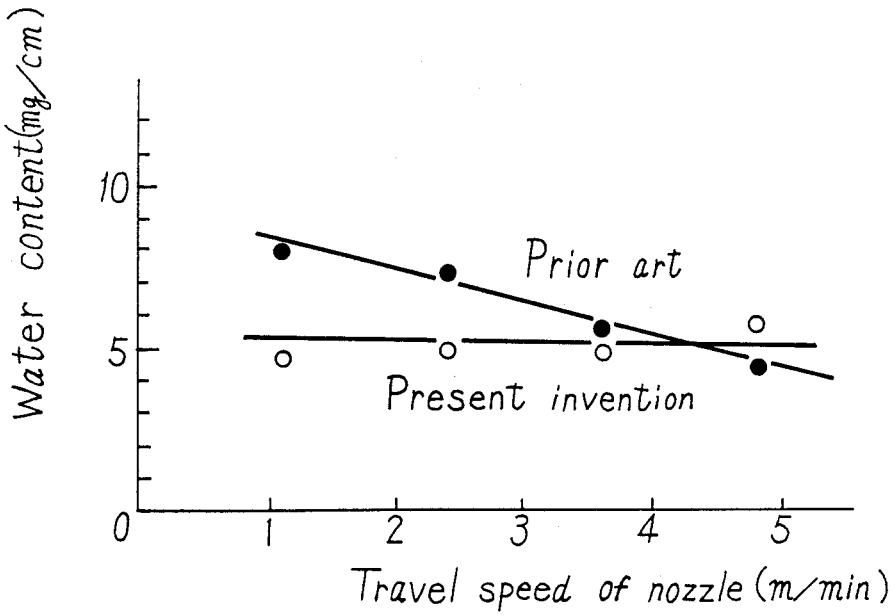

The characteristics of the sewing operation determined by the experiment are as follows:

FIGS. 2 and 3 show the relationships among the sewing force, water content and nozzle speed with a conventional technology that shoots a jet stream from only one side, with a reflector provided on the other side, and above described technology of this invention, with the nozzle diameter and jet stream pressure set at 0.06 mm and 600 kgf/cm$^2$, respectively. Obviously, the technology according to this invention produces a much greater seam strength than the conventional one.

As is obvious from FIG. 2, the strength of a seam formed by the action of the jet streams decreases as the running speed of the nozzles increases. Temporary sewing must be performed with a force of approximately 20 gf/cm in order to permit the superimposed pieces of cloth sewn together to be carried forward in one piece either pneumatically or over a conveyor. With the nozzle diameter of 0.06 mm and jet nozzle pressure of 600 kgf/cm$^2$, the above required seam strength appeared to be obtainable with a sewing speed (i.e., nozzle speed) of approximately 10 m/min.

The water content in the specimen prepared by the technology of this invention was constant (5 mg/cm) without being affected by the nozzle speed. The value was close to the water content of 3 mg/cm resulting from an operation in which the jet stream was allowed to pass through the superimposed pieces of cloth without providing a reflector. (see FIG. 3)

Overcompressed jet streams can damage the pieces of cloth to be sewn together. According to the results of tensile tests, the specimens prepared by the conventional technology under different jet stream pressures proved to remain undamaged under a jet stream pressure of not higher than 600 kgf/cm$^2$ when the nozzle diameter is between 0.06 and 0.08 mm and not higher than 400 kgf/cm$^2$ with the nozzle diameter of 0.10 mm. In contrast, the technology of this invention that shoots jet streams from both sides of the superimposed pieces of cloth permits decreasing the extent to which the influence of the jet streams reaches, thereby reducing the risk of damage accordingly.

Figure 4:
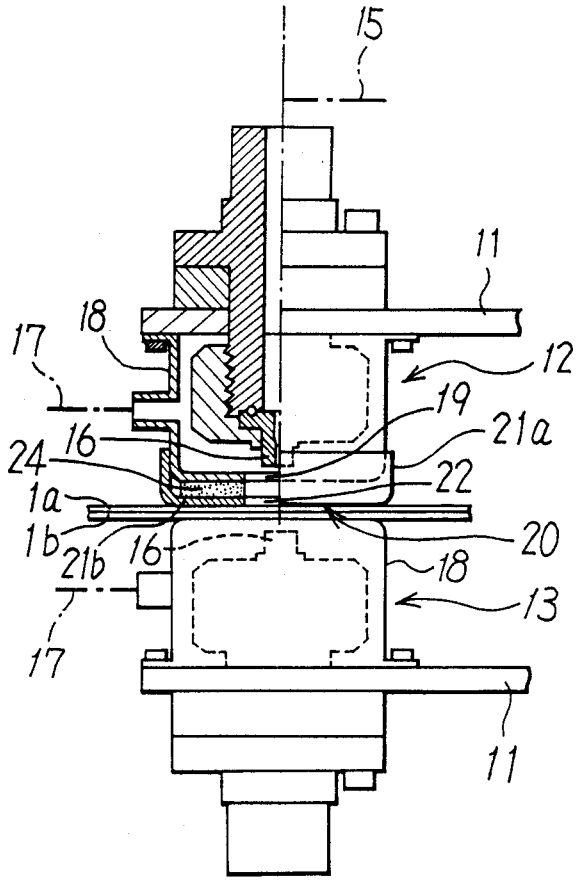
FIG. 4 is a partially cut-away side elevation of another preferred embodiment of a cloth sewing apparatus according to this invention.

FIG. 4 shows another preferred embodiment of this invention in which a keeping plate is added to the sewing apparatus of the type described previously.

This preferred embodiment, like the one previously described, sews together two superimposed pieces of cloth 1*a*, 1*b*, with high-pressure jet streams. Support frames 11 carry a pair of vertically disposed jet stream shooting means 12, 13 that shoot forth fine jet streams of a liquid or a mixed fluid of gas and liquid under pressure from both sides of the superimposed pieces of cloth. Each of the shooting means 12, 13 has a nozzle 16 that is connected to a compressor through a high-pressure fluid pipe 15. A pair of nozzles 16 are vertically disposed in opposite positions so that they shoot jet streams to the same point on both sides of the superimposed pieces of cloth 1*a*, 1*b*. Each of the nozzles 16 is covered with a cover 18 that leads to a suction unit now shown through a suction pipe 17. The covers 18 have an opening 19 where the jet streams are ejected from the opposite nozzles 16 in order to allow them to act on the superimposed pieces of cloth.

The cover 18 for the upper jet stream shooting means 12 has a cup-shaped keep plate 20 comprising of a cylindrical portion 21*a* slidably fitted over the cover 18 and an end portion 21*b* having an opening 22 in the center thereof where the jet stream is ejected. Between the keep plate 20 and the cover 18 is interposed an elastic member 24 to hold down the superimposed pieces of cloth 1*a*, 1*b*. The keep plate may also be provided on the cover 18 for the lower jet stream shooting means 13 or on both of the top and bottom covers.

The lower side of the end portion 21*b* of the keep plate 20 should preferably be finished smooth enough to permit smooth motion of the superimposed pieces of cloth held between that portion and the bottom cover 18. The keep plate 20 is made of such material as plastic and stainless steel that are corrosion resistant to the liquid shot forth in jet streams. The elastic member 24 is a piece of sponge, rubber or metal spring.

With this apparatus, the superimposed pieces of cloth can be sewn together as with the previously described first preferred embodiment shown in FIG. 1. During sewing, the suction by the suction unit from within the covers 18 may exert a sucking force on the superimposed pieces of cloth 1*a*, 1*b* through the openings 19, 22 through which the jet streams pass, working to part one of the superimposed pieces 1*a*, 1*b* from the other. Even so, the keep plate 20 urged by the elastic member 24 to hold down the superimposed pieces of cloth 1*a*, 1*b* on the bottom cover 18 with a large enough force to nullify the influence of the sucking force assures stable sewing, keeping the superimposed pieces of cloth 1*a*, 1*b* from parting. The keep plate 20 adds another contribution to the achievement of stable sewing, making the clearance between the top and bottom covers 18 readily adjustable with changes in the thickness of the superimposed pieces of cloth held therebetween.

With the two preferred embodiments described above, the following problem arises with respect to the control of the cloth sewing operation with jet streams.

To obtain the desired jet stream for sewing, generally water under a pressure of 300 to 1000 kgf/cm$^2$ is shot forth from a nozzle having an inside diameter of 0.05 to 0.1 mm. But it takes a considerably long time for a compressor pump to attain the desired water pressure from the startup and to come to a stop from the operating condition.

With a long continuous sewing operation, the pump may be started to generate the desired jet stream after moving the nozzle to the starting position and stopped after completing the sewing operation. But when sewing is repeatedly started and stopped within a relatively short time, some means to control the sewing operation is needed.

To overcome this problem, the inventors tried for the control of the jet stream with a solenoid valve. But the liquid pressure was too high to maintain stable valve operation. To permit the intermittent flow of such a high-pressure liquid, in addition, it was found necessary to provide an upstream seal that can withstand a very great pressure. Temporary closing and opening of the high-pressure fluid passage created pressure variations. Especially at the start of sewing, the intensity of the jet stream varied to such an extent with varying pressures as to prevent the achievement of a uniform satisfactory sewing operation.

Then, it was found possible to achieve the desired control of the sewing operation by use of a shielding plate 30 that is provided between each nozzle 6 and the superimposed pieces of cloth, as shown by a dot-dash line in FIG. 1, in such a manner as to be sent into and retracted from the path of the jet stream by a solenoid or other drive unit 31 to allow or cut off the passage of the jet stream from the nozzle.

With this provision, the pump is started to shoot off a jet stream at a given high pressure from the nozzle before starting sewing, with the jet stream from the nozzle cut off by the shielding plate 30 sent into the path thereof. The shielding plate 30 is retracted from the path of the jet stream when sewing is started, and then sent back into the path to cut off the flow of jet stream to the superimposed pieces of cloth when sewing is finished. Splashes of the jet stream colliding with the shielding plate and the superimposed pieces of cloth are sucked from within the cover to enclose the nozzle to the outside.

This retractable shielding plate permits starting and stopping sewing instantaneously, thereby stabilizing the strength of the produced seam on the sewn pieces of cloth.

The shielding plate 30 and drive unit 31 may also be provided on the keep plate 20 in the preferred embodiment shown in FIG. 4.

What is claimed is:

1. In a method of sewing together pieces of cloth comprising holding the pieces of cloth one on top of another with sewing fibers extending therefrom, wherein said pieces of cloth are superimposed on one another, shooting a fine jet stream of a high-pressure liquid against the superimposed pieces of cloth, moving a shooting position of the jet stream relative to the pieces of cloth and causing the sewing fibers to twine with the pieces of cloth, wherein said method comprises the steps of:

(a) shooting the jet stream to a same point on the superimposed pieces of cloth from both sides of said superimposed pieces of cloth, thereby causing the sewing fibers to twine with one another or with the pieces of cloth; and (b) sucking and removing splashing liquid or fluid from an area on said superimposed pieces of cloth where said jet stream is shot.

2. The method according to claim 1, wherein water compressed by a compressor is shot forth from a nozzle to the superimposed pieces of cloth as the jet stream.

3. The method according to claim 1, wherein water compressed to a pressure approximately between 300 and 1000 kgf/cm$^2$ is shot forth from a nozzle having an inside diameter approximately between 0.05 and 0.01 mm to the superimposed pieces of cloth.

4. The method according to claim 1, wherein part of the jet stream shot against the superimposed pieces of cloth is allowed to penetrate the superimposed pieces of cloth to collide with each other at high speed and violently splash about, thereby promoting the twining of sewing fabrics and reducing an amount of the liquid left behind in the superimposed pieces of cloth.

5. The method according to claim 1, wherein nozzles are used for shooting the jet stream, each nozzle shooting forth the jet stream is enclosed with a cover, with an atmosphere therein sucked by a sucking unit to remove the splashing liquid through a suction pipe.

6. The method according to claim 5, wherein a keep plate to hold down the superimposed pieces of cloth while covering the nozzle in conjunction with the cover is attached thereto, with the sewing with the jet stream performed while elastically holding down the superimposed pieces of cloth that tend to part from each other under an influence of a sucking force.

7. The method according to claim 1, wherein a surface treatment chemical to be applied on the superimposed pieces of cloth is used as the liquid to shoot forth from the nozzle.

8. In a sewing apparatus comprising means for holding superimposed pieces of cloth with sewing fibers extending from the superimposed pieces of cloth themselves, jet spray means to shoot a fine jet stream of a liquid under pressure from a nozzle to the superimposed pieces of cloth and means for moving a shooting position of the nozzle relative to the superimposed pieces of cloth, said apparatus comprising:

(a) nozzles disposed so as to shoot jet streams to a same point on the superimposed pieces of cloth from both sides of said superimposed pieces of cloth; and (b) covers surrounding the nozzles and leading to suction units to suck and remove splashing liquid.

9. In a sewing apparatus comprising means for holding superimposed pieces of cloth with sewing fibers extending from the superimposed pieces of cloth themselves, jet spray means to shoot a fine jet stream of a liquid under pressure from a nozzle to the superimposed pieces of cloth and means for moving a shooting position of the nozzle relative to the superimposed pieces of cloth, said apparatus comprising:

(a) nozzles disposed so as to shoot jet streams to a same point on the superimposed pieces of cloth from both sides thereof;

(b) covers surrounding the nozzles and leading to suction units to suck and remove splashing liquid; and (c) a keep plate attached to at least one of said covers to cover the jet stream shooting nozzle in conjunction with the cover and hold down the superimposed pieces of cloth held between itself and another cover by the action of an elastic member.

10. The apparatus according to claim 9, wherein the keep plate, to hold down the superimposed pieces of cloth, is cup-shaped, comprising a cylindrical portion slidably fitted over the cover and an end portion having an opening in a center thereof where the jet stream is ejected, with the elastic member to press the keep plate against the superimposed pieces of cloth interposed between the keep plate and the cover over which the keep plate is fitted.

* * * * *